US006024544A

United States Patent [19]

Kim et al.

[11] Patent Number: 6,024,544

[45] Date of Patent: Feb. 15, 2000

[54] COOLANT SUPPLY APPARATUS FOR LINEAR COMPRESSOR

[75] Inventors: Hyung Jin Kim, Seoul; Hyung Kook Lee, Kyungki-Do, both of Rep. of Korea

[73] Assignee: LG Electronics Inc., Rep. of Korea

[21] Appl. No.: 08/793,552

[22] PCT Filed: Jun. 24, 1996

[86] PCT No.: PCT/KR96/00096

§ 371 Date: Feb. 21, 1997

§ 102(e) Date: Feb. 21, 1997

[87] PCT Pub. No.: WO97/01033

PCT Pub. Date: Jan. 9, 1997

[30] Foreign Application Priority Data

Jun. 23, 1995 [KR] Rep. of Korea ..... 95-17075
Jun. 23, 1995 [KR] Rep. of Korea ..... 95-17077

[51] Int. Cl.[7] ..... F04B 17/04; F01M 1/00

[52] U.S. Cl. ..... 417/417; 184/6.8; 137/855

[58] Field of Search ..... 417/363, 417, 417/418, 372, 416; 184/6.17, 6.8; 137/512, 855

[56] References Cited

U.S. PATENT DOCUMENTS 3,325,085 6/1967 Gaus ..... 417/416
4,808,085 2/1989 Nishitsuji ..... 417/363
5,009,286 4/1991 Ikeda et al. ..... 184/6.17
5,772,410 6/1998 Chang ..... 417/363

*Primary Examiner*—John J. Vrablik
*Attorney, Agent, or Firm*—Ostrolenk, Faber, Gerb & Soffen, LLP

[57] ABSTRACT

A coolant supply apparatus for a linear compressor which includes a stator mounted at one side of a flange for generating a magnetic field therearound and a horizontal operating unit which reciprocates horizontally. The horizontal operating unit includes a magnet disposed inside the stator and a piston, which is integral with the magnet and reciprocates horizontally within a cylinder. The coolant supply apparatus further includes a coolant oil pocket for guiding a predetermined amount of coolant oil to an outer circumferential surface of the cylinder in cooperation with a suction force of the piston and for cooling a heat generated in the cylinder. A plurality of coolant oil sucking/discharging holes are formed at the cylinder in order for the coolant oil filled in the coolant oil pocket to be introduced between the cylinder and the piston therethrough. A coolant oil discharging hole is formed in order for a predetermined amount of the coolant oil filled in the coolant oil pocket to be discharged therethrough. A valve plate is provided for introducing the coolant oil discharged through the coolant oil discharging hole and for preventing the leakage of a refrigerant gas.

5 Claims, 8 Drawing Sheets

COOLANT SUPPLY APPARATUS FOR LINEAR COMPRESSOR

TECHNICAL FIELD

The present invention relates to a coolant supply apparatus for a linear compressor, and particularly to an improved coolant supply apparatus for a linear compressor which is capable of enabling a more smooth reciprocating operation of a piston by substantially supplying a coolant oil between a cylinder and a piston and preventing a leakage of a refrigerant gas by supplying a predetermined amount of coolant to a valve plate.

BACKGROUND ART

FIGS. 1 through 3 show a conventional linear compressor, which includes a predetermined shaped cylinder 2 disposed within a housing 1 of the linear compressor, and a stator 3 disposed at the outside of the cylinder 2 for generating a magnetic field therearound.

A horizontal operating unit 4, which horizontally reciprocates in cooperation with the stator 3, is disposed at one side of the cylinder 2.

The horizontal operating unit 4 includes' a magnet 5 which horizontally reciprocates within the stator 3 in cooperation with an alternating magnetic force generated by the stator 3; a piston 6, which is integral with the magnet 5 and reciprocates within the cylinder 2; a piston spring 7 disposed at the piston 6 and the magnet 5 for generating a predetermined elastic force, and a mounting spring 8 disposed at a predetermined portion of the housing 1 for supplying an elastic energy to the piston spring 7.

A predetermined amount of a coolant 9 is filled at the lower portion of the housing 1.

At the other side of the cylinder 2, there is provided a valve plate 10 including a suction gasket 11, a suction valve sheet 12, a valve sheet 13, a discharging valve sheet 14, and discharging gasket 15 in order for the refrigerant gas to be sucked into or discharged from the cylinder 2.

A suction portion muffler 16 and a discharging portion muffler 17 are provided at a predetermined portion of the valve plate 10. A head cover 18 is disposed at the upper portion of the suction portion muffler 16 and the discharging portion muffler 17 in order for the above-mentioned elements to be fixed to the cylinder 2.

The suction gasket 11 is disposed between the suction valve sheet 12 and the cylinder 2 for preventing the leakage of the coolant gas. A first sucking/discharging hole 19 is formed at the center portion of the suction gasket 11 for sucking/discharging the refrigerant gas therethrough.

A suction opening portion 20 is formed at the central portion of the suction valve sheet 12 for being opened by the suction force or the discharging force of the coolant gas, and a first discharging hole 21 is formed at one side of the suction opening portion 20.

A first suction hole 22 is formed at the central portion of the discharging valve sheet 14 in order for the refrigerant gas to be sucked therethrough, and a discharging opening/closing portion 23 is formed at one side of the suction hole for being opened/closed by the suction force or the discharging force of the coolant gas.

The valve sheet 13 is positioned between the suction valve sheet 12 and the discharging valve sheet 14. A second suction hole 24 is formed at the central portion of the valve sheet 13 in order for the refrigerant gas to be sucked therethrough, and a second discharging hole 25 is formed at one side of the second suction hole 24 in order for the refrigerant gas to be discharged.

A discharging gasket 15 is positioned between the discharging valve sheet 14 and the head cover 18 for preventing the leakage of the coolant gas, and a second sucking/discharging hole 26 is formed at the central portion of the discharging gasket 15 in order for the refrigerant gas to be sucked/discharged therethrough.

A capalliar tube 27 is disposed at a predetermined portion of the suction muffler 16 in order for the coolant oil 9 to be sucked into the suction muffler 16 in cooperation with the suction force of the piston 6.

The operation of the conventional linear compressor will now be explained with reference to the accompanying drawings.

First, when the stator 3 is supplied with a current, a magnetic field is formed therearound. The thusly formed magnetic field alternately communicates with the magnetic field generated by the magnet 5, so that a horizontal movement of the piston 6 of the horizontal operating unit 4 is made.

Thereafter, the refrigerant gas sucked into the suction muffler 16 in cooperation with the suction force of the piston 6 passes through the second suction/discharging hole 26 of the discharging gasket 15, the first suction hole 22 of the discharging valve sheet 14, and the second suction hole 24 in order, and then pushes the suction opening/closing portion 20 of the valve sheet 13, and is introduced into the cylinder 2 through the first sucking/discharging hole 19 of the suction gasket 11. At this time, the suction force of the piston 6 pushes the discharging opening/closing portion 23 of the discharging valve sheet 14 so as to close the second discharging hole 25 of the valve sheet 13.

Meanwhile, the coolant oil 9 introduced into the suction muffler 16 together with the refrigerant gas in cooperation with the suction force of the piston 6 serves as a lubricant in the cylinder 2 after it is introduced into the cylinder 2 through the valve plate 10.

Thereafter, when the refrigerant gas and the coolant oil 9 are compressed by the reciprocating movement of the piston 6, the refrigerant gas in the cylinder 2 passes through the first sucking/discharging hole 19 of the suction gasket 11, the first discharging hole 21 of the suction valve sheet 12, and the second discharging hole 25 of the valve sheet 13. The gas then pushes through the discharging opening/closing portion 23 of the discharging valve sheet 14 and passes to the discharging muffler 17 through the second sucking/discharging hole 26 of the discharging gasket 15.

Meanwhile, the coolant oil is discharged together with the refrigerant gas in cooperation with the discharging force of the piston 6 along the same path as the coolant gas.

The coolant oil 9 introduced into the cylinder 2 is discharged such that the coolant oil 9 is not substantially provided between the cylinder 2 and the piston 6. The lubricant operation in the system is therefore degraded, and the heat generated within the cylinder 2 can not be substantially cooled.

In addition, since a lot of coolant oil 9 is discharged, the discharging force of the refrigerant gas compressed in the cylinder 2 is weakened.

Moreover, the refrigerant gas sucked into and discharged from the valve plate 10 may leak.

SUMMARY OF THE INVENTION

Accordingly, it is an object of the present invention to provide an improved coolant supply apparatus for a linear compressor which overcomes the problems encountered in the conventional coolant supply apparatus for a linear compressor.

It is another object of the present invention to provide a coolant supply apparatus for a linear compressor which is capable of enabling a more smooth reciprocating operation of a piston by substantially supplying a coolant (oil) between a cylinder and a piston and preventing a leakage of a refrigerant gas by supplying a predetermined amount of coolant to a valve plate.

To achieve the above objects, there is provided a coolant supply apparatus for a linear compressor which includes a stator mounted at one side of a flange for generating a magnetic field therearound; a horizontal operating unit, which horizontally reciprocates, including a magnet disposed inside the stator and a piston, which is integral with the magnet, horizontally reciprocating within a cylinder; a coolant oil pocket for guiding a predetermined amount of coolant oil to an outer circumferential surface of the cylinder in cooperation with a suction force of the piston and for cooling a heat generated in the cylinder; a plurality of coolant oil sucking/discharging holes formed at the cylinder in order for the coolant oil filled in the coolant oil pocket to be introduced between the cylinder and the piston therethrough; a coolant oil discharging hole formed in order for a predetermined amount of the coolant oil filled in the coolant oil pocket to be discharged therethrough; and a valve plate for introducing the coolant oil discharged through the coolant oil discharging hole and for preventing the leakage of a refrigerant gas.

BRIEF DESCRIPTION OF THE DRAWINGS

The present invention will become more fully understood from the detailed description given hereinbelow and the accompanying drawings which are given by way of illustration only, and thus do not limit the present invention, and wherein.

MODES FOR CARRYING OUT THE INVENTION

Figure 1:
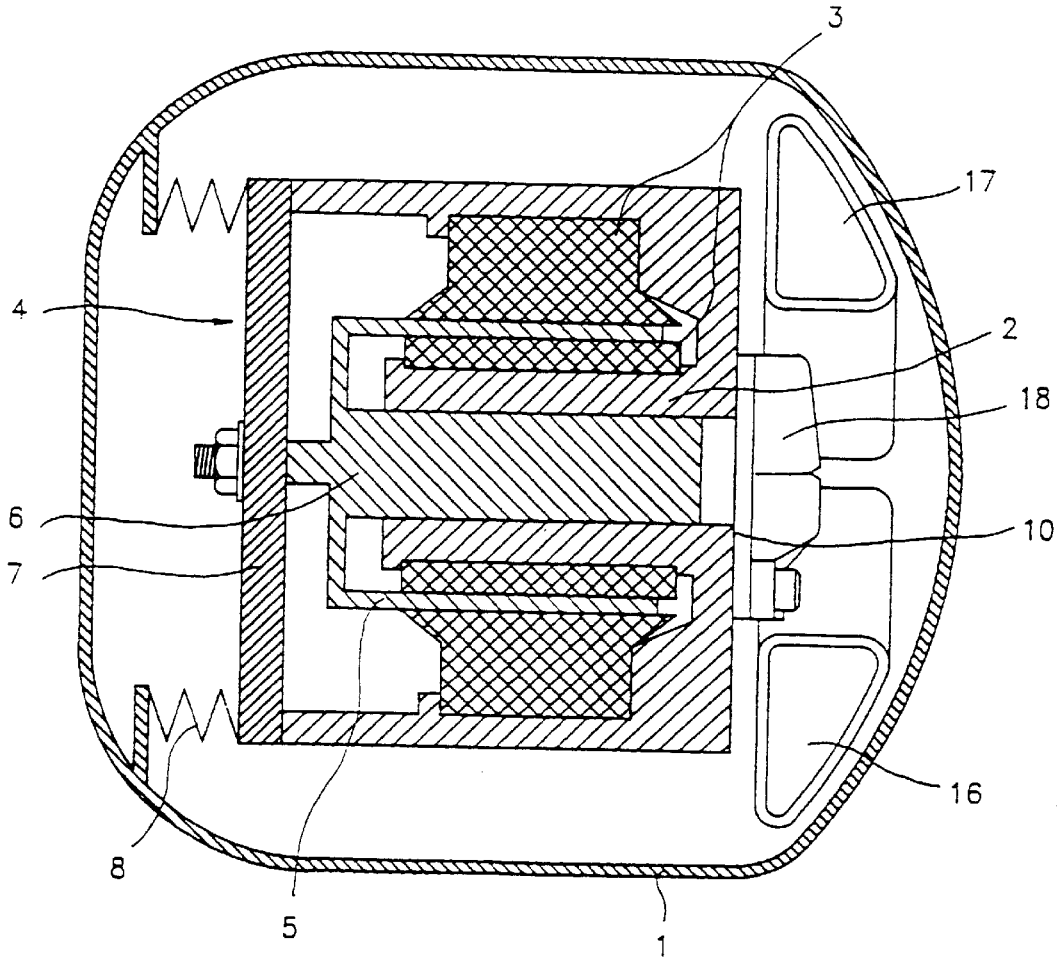
FIG. 1 PRIOR ART
FIG. 1 is a cross-sectional view showing a conventional linear compressor.
Figure 2:
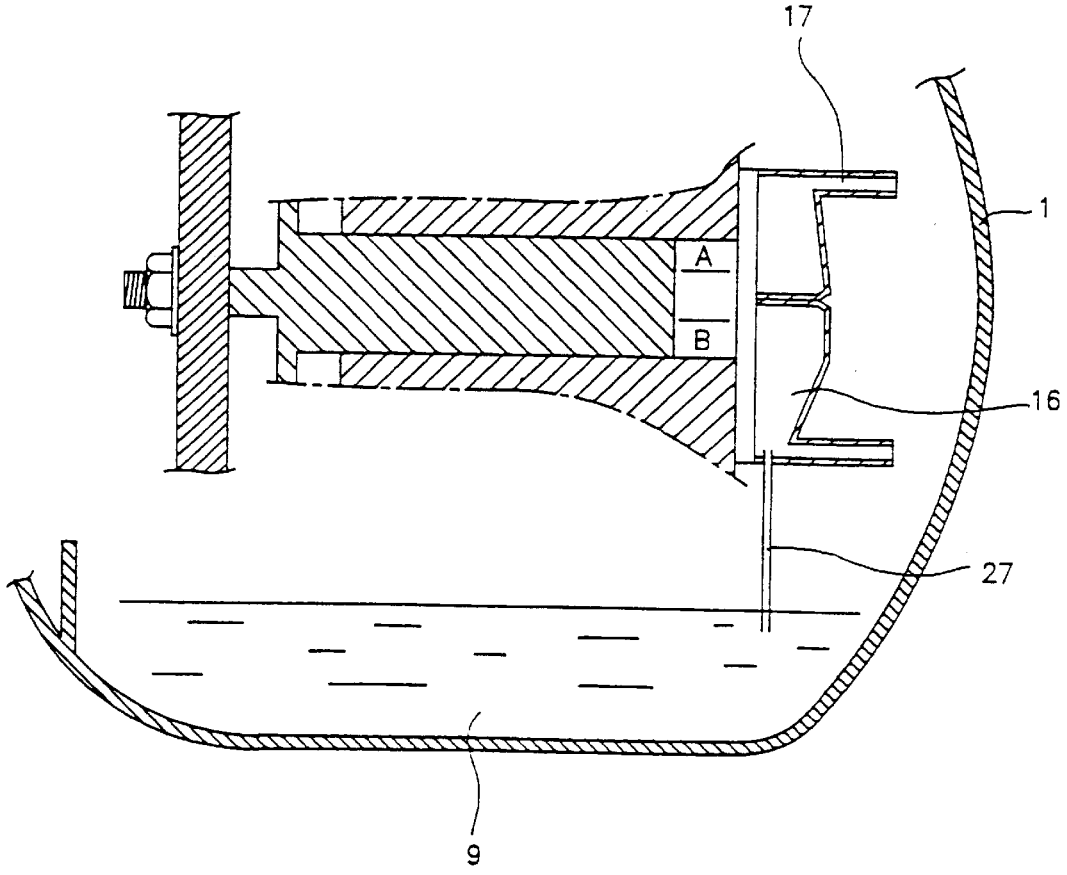
FIG. 2 PRIOR ART
FIG. 2 is a partially cut-away cross-sectional view showing a conventional coolant oil supply apparatus for a linear compressor.
Figure 3:
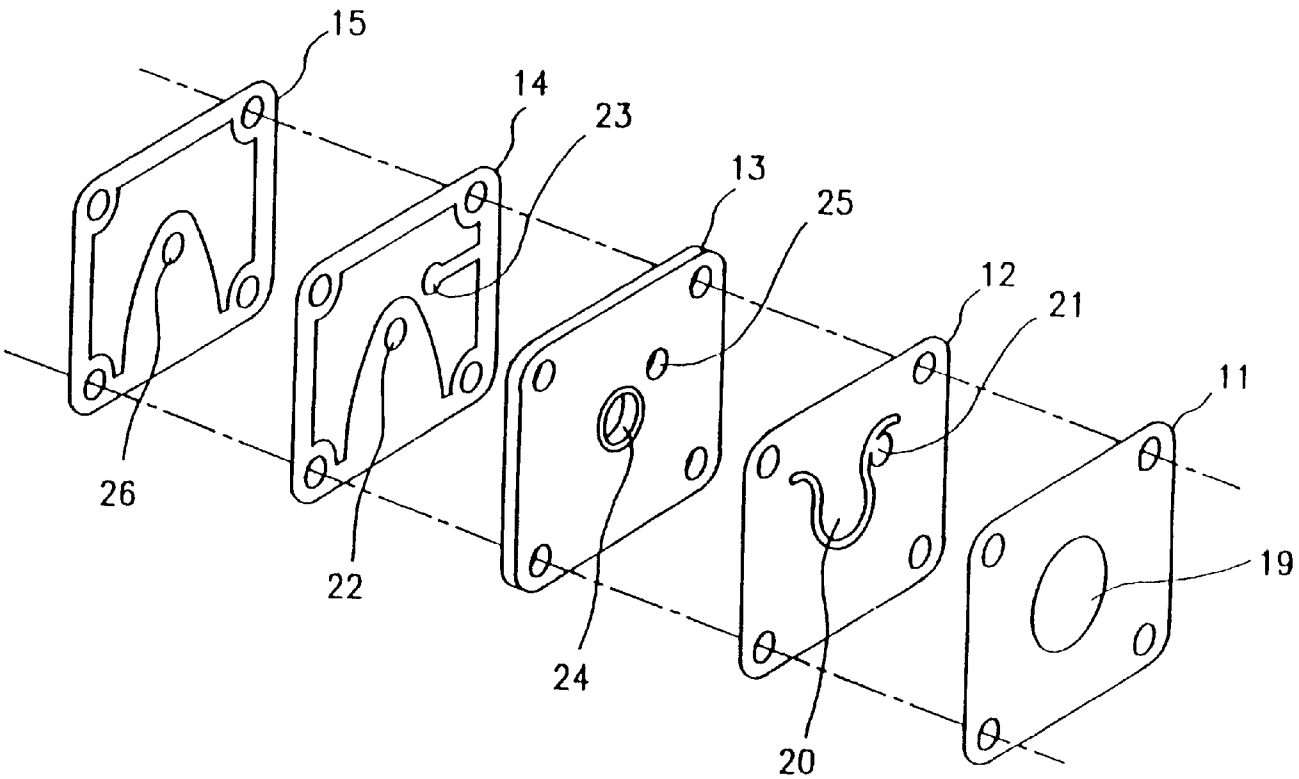
FIG. 3 PRIOR ART
FIG. 3 is a disassembled perspective view of a valve plate of a conventional linear compressor.

FIGS. 4 through 8 show a coolant oil supply apparatus for a linear compressor according to the present invention, which includes a housing 30 in which a coolant oil 31 is filled at the lower portion of the same, and a cylinder 32 is disposed at a predetermined portion in the housing 30.

A coolant oil pocket 33 for receiving a predetermined amount of the coolant oil 31 is formed at an outer circumferential portion of the cylinder 32.

The coolant oil pocket 33 includes a core liner 34 of which one end is engaged to the cylinder 32 and spaced apart from the outer circumferential surface of the cylinder 32 by a predetermined distance, and an O-ring 35 inserted between the other end of the core liner 34 and the outer circumferential surface of the cylinder 32 for preventing leakage of the coolant oil.

A capillary tube 36 is disposed at a predetermined portion of the coolant oil pocket 33 in order for the coolant oil 31 to be supplied to the coolant oil pocket 33.

An inner lamination 37 composed of a plurality of steel plates and engaged with a flange 38 is disposed at the upper portion of the core liner 34. A stator 41 composed of a core 39 and a coil 40 and engaged to the flange 38 is disposed at an upper portion of the inner lamination 37.

A horizontal operating unit 42 is disposed at one side of the cylinder 32. A magnet 43 is disposed between the stator 41 and the inner lamination 37 for being horizontally moved in cooperation with the alternating operation of the same, and a piston 44 integral with the magnet 43 is disposed at one end of the magnet 43 and reciprocates within the cylinder 32 in cooperation with the horizontal movement of the magnet 43.

A plurality of sucking/discharging holes 45 are formed at the cylinder 32 so that the coolant oil 31 filled in the coolant oil pocket 33 can be introduced between the cylinder 32 and the piston 44.

A coolant oil discharging hole 46 is formed at the other side of the cylinder 32 in order for the coolant oil 31 to be discharged therethrough.

A valve plate 47 is mounted at the other side of the cylinder 32 in order for the refrigerant gas and a predetermined amount of the coolant oil 31 to pass therethrough. As shown in FIGS. 5–8, various embodiments of the valve plate 47 include suction gaskets 48, 68, 85, and 106, suction valve sheets 49, 71, 90, and 106, valve sheets 50, 75, 94, and 113, discharging valve sheets 51, 80, 98, and 117, and discharging gaskets 52, 83, 103, and 122.

The elements of the valve plate as shown in FIGS. 5 through 8 are engaged to one another.

Figure 4:
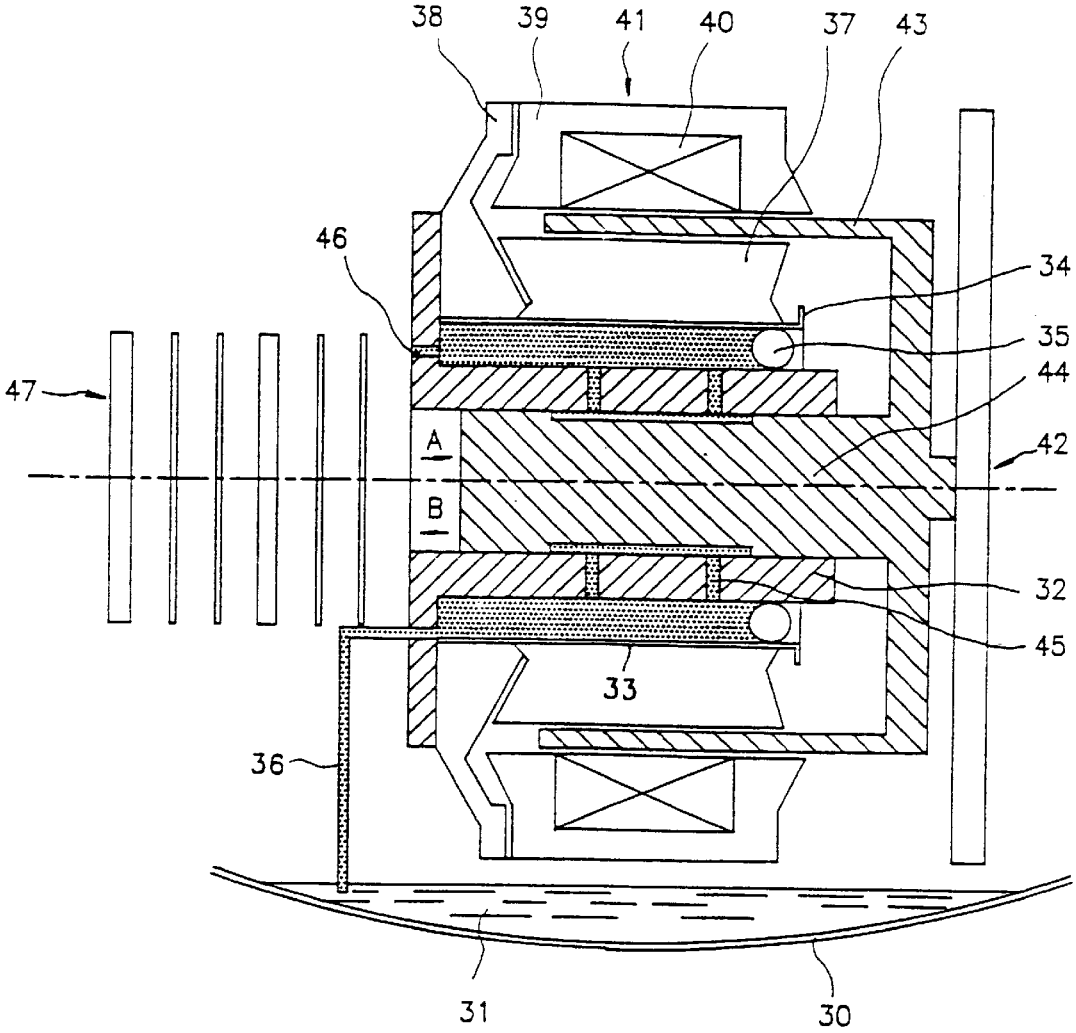
FIG. 4 is a partially cut-away cross-sectional view showing a coolant oil supply apparatus for a linear compressor according to a first embodiment of the present invention.
Figure 5:
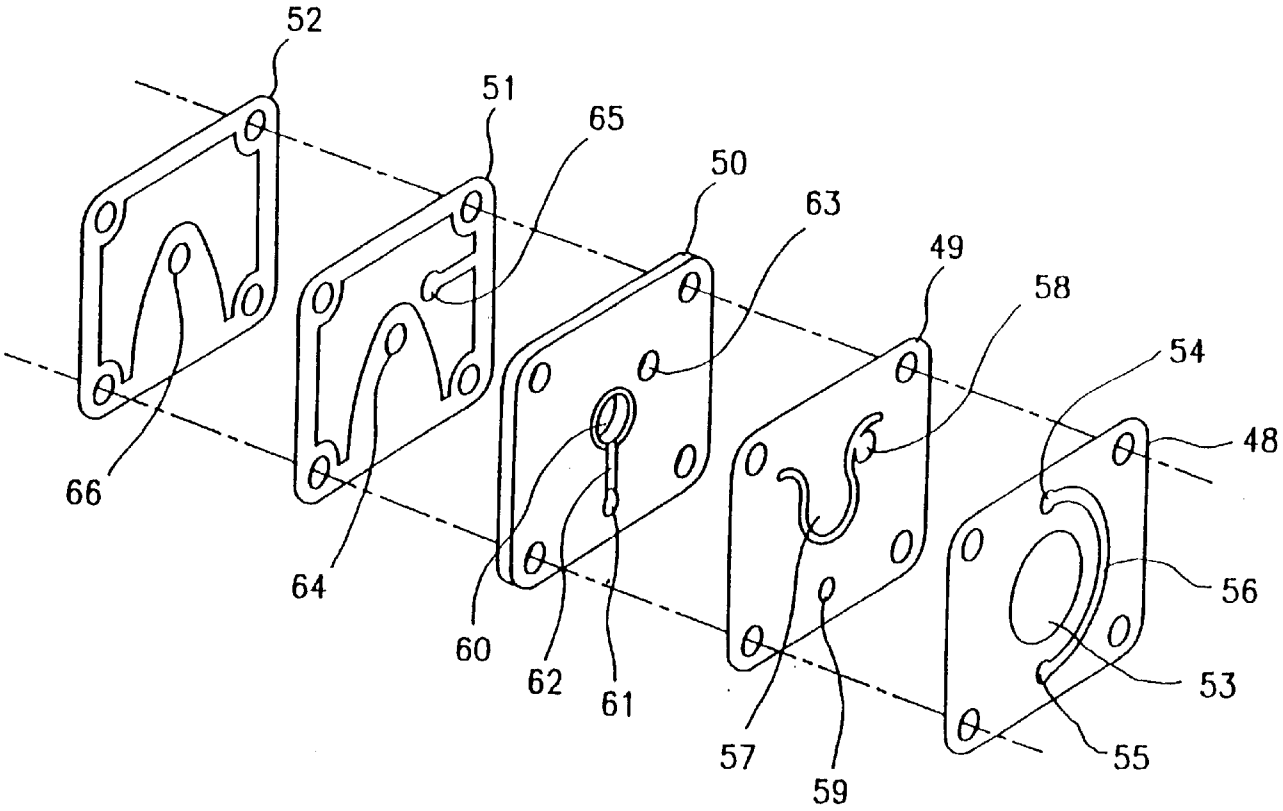
FIG. 5 is an exploded view showing a valve plate of FIG. 4.

In the first embodiment of the present invention as shown in FIGS. 4 and 5, the suction gasket 48 includes a first sucking/discharging hole 53 formed at the center portion of the same in order for the refrigerant gas to pass therethrough. A first introducing hole 54 is formed at the upper portion of the first sucking/discharging hole 53 in order for the coolant oil 31 discharged from the coolant oil discharging hole 46 of the cylinder 32 to be introduced therethrough. A first discharging hole 55 is formed at the lower portion of the first sucking/discharging hole 53 in order for the coolant oil 31 to be discharged. A semicircular-shaped first guide hole 56 is formed around the first sucking/discharging hole 53 in order for the coolant oil 31 introduced through the first introducing hole 54 to be guided to the first discharging hole 55.

The suction valve sheet 49 includes a first suction opening/closing portion 57 formed at the center portion of the same for being opened/closed by the suction force or the discharging pressure of the coolant gas. A first discharging hole 58 is formed at a position spaced apart from the first introducing hole 54 of the suction gasket 48. A first passing-through hole 59 is formed at a predetermined portion in valve sheet 49 as to spatially communicate with the first discharging hole 55 of the suction gasket 48 in order for the coolant oil 31 to pass therethrough.

The valve sheet 50 includes a first suction hole 60 formed at the center portion of the same in order for the refrigerant gas to pass therethrough. A second passing-through hole 61 is formed at a predetermined portion so as to spatially communicate with the first passing-through hole 59 in order for the coolant oil 31 to pass therethrough. A first guide groove 62 is formed between the second passing-through hole 61 and the first suction hole 60 in order for the coolant oil 31 to be guided thereby. A second discharging hole 63 is formed at a predetermined portion so as to spatially communicate with the first discharging hole 58 of the suction valve sheet 49.

A second suction hole 64 is formed at the center portion of the discharging valve sheet 51. A first discharging opening/closing portion 65 is formed at a predetermined portion so as to spatially communicate with the second discharging hole 63 of the valve sheet 48 in order for the first discharging opening/closing portion 65 to be opened/closed by the suction force or discharging force of the coolant gas.

The discharging gasket 52 includes a second sucking/discharging hole 66 formed at the center portion of the same in order for the refrigerant gas to pass therethrough.

Figure 6:
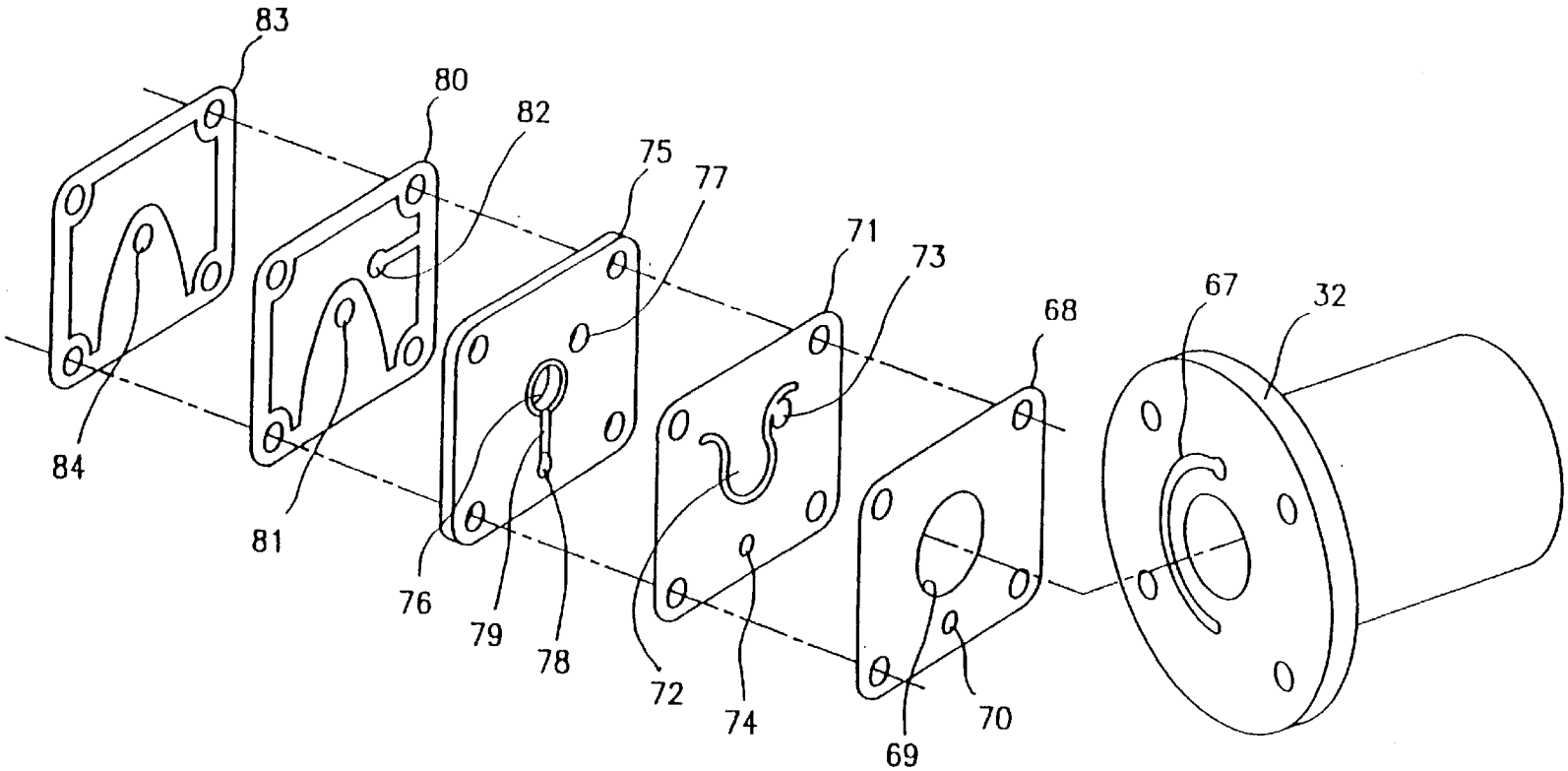
FIG. 6 is an exploded view showing a valve plate of a coolant oil supply apparatus for a linear compressor according to a second embodiment of the present invention.

Next, the second embodiment of the present invention as shown in FIG. 6 will now be explained.

First, as shown therein, a semicircular-shaped second guide groove 67 is formed at the other side of the cylinder 32 in order for the coolant oil 31 discharged through the coolant oil discharging hole 46 to be guided thereby.

The suction gasket 68 includes a fifth sucking/discharging hole 69 formed at the center portion of the same in order for the refrigerant gas to pass therethrough. A second guide hole 70 is formed at a predetermined portion so as to spatially communicate with the end portion of the second guide groove 67 of the cylinder 32.

A suction valve sheet 71 includes a second suction opening/closing portion 72 formed at the center portion of the same in order for the second suction opening/closing portion 72 to be opened/closed by the suction force or discharging force of the coolant gas. A fifth discharging hole 73 is formed at one side of the second suction opening/closing portion 72, and a third passing-through hole 74 is formed at a predetermined portion so as to spatially communicate with the second guide hole 70 of the suction gasket 68 in order for the coolant oil 31 to be guided thereby.

A valve sheet 75 includes a fifth suction hole 76 formed at the center portion of the same in order for the refrigerant gas to pass therethrough. A sixth discharging hole 77 is formed at a predetermined portion so as to spatially communicate with the fifth discharging hole 73 of the suction valve sheet 71. A fourth passing-through hole 78 is formed at a predetermined portion so as to spatially communicate with third passing-through hole 74 of the suction valve sheet 71. A third guide groove 79 is formed between the fifth suction hole 76 and the fourth passing-through hole 78 in order for the coolant oil 31 to be guided thereby.

A discharging valve sheet 80 includes a sixth suction hole 81 formed at the center portion of the same. A second discharging opening/closing portion 82 is formed at a predetermined portion so as to spatially communicate with the sixth discharging hole 77 of the valve sheet 75 in order for the second discharging opening/closing portion 82 to be opened/closed by the suction force or discharging force of the coolant gas.

A discharging gasket 83 includes a sixth sucking/discharging hole 84 formed at the center portion of the same in order for the refrigerant gas to be sucked/discharged therethrough.

Figure 7:
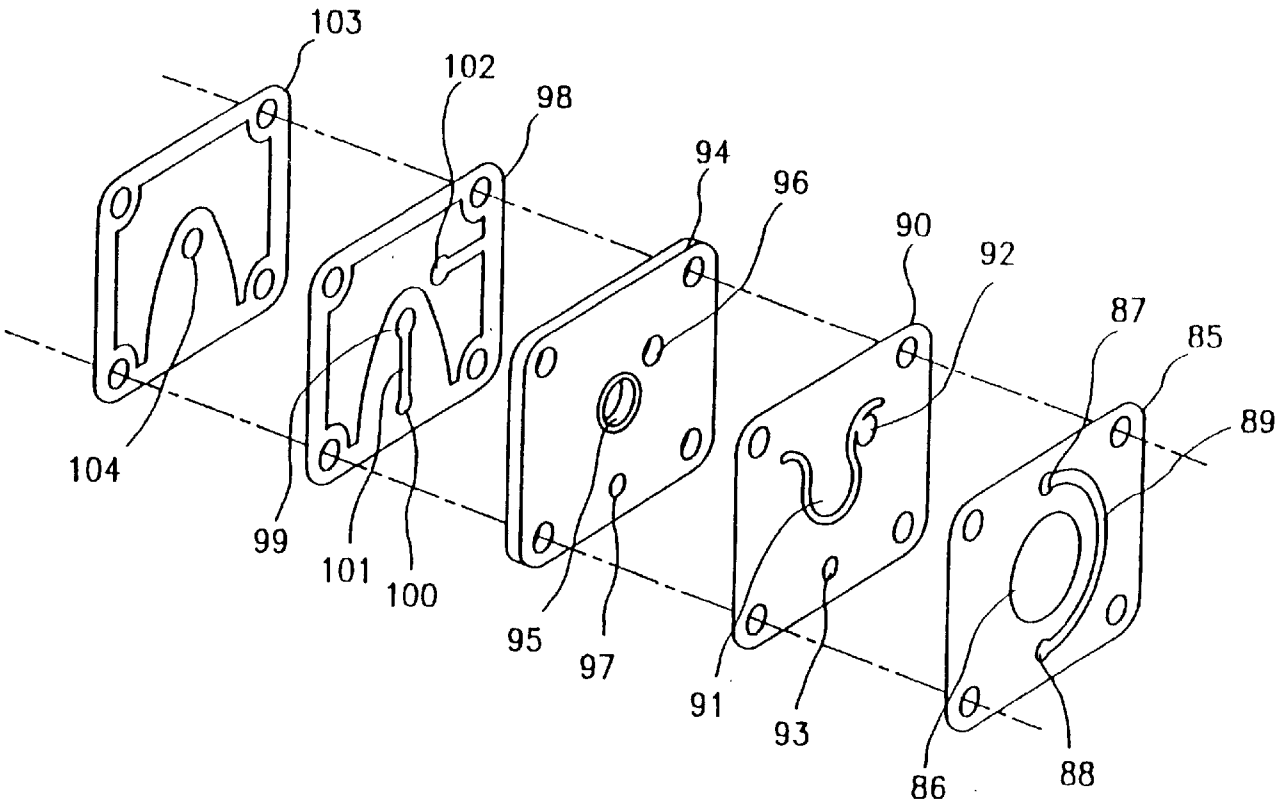
FIG. 7 is an exploded view showing a valve plate of a coolant oil supply apparatus for a linear compressor according to a third embodiment of the present invention.

Next, FIG. 7 shows the third embodiment of the present invention, which includes a seventh sucking/discharging hole 86 formed at the center portion of the same in order for the refrigerant gas to pass therethrough. A second introducing hole 87 is formed at the upper portion of the seventh sucking/discharging hole 86 in order for the coolant oil 31 discharged from the coolant oil discharging hole 46 of the cylinder 32 to be introduced therethrough. A second discharging hole 88 is forced at the lower portion of the seventh sucking/discharging hole 86 in order for the coolant oil 31 to be discharged therethrough. A semicircular-shaped third guide hole 89 is formed around the seventh sucking/discharging hole 86 in order for the refrigerant gas introduced into the second introducing hole 87 to be guided to the second discharging hole 88 thereby.

A suction valve sheet 90 includes a third suction opening/closing portion 91 formed at the center portion of the same in order for the third suction opening/closing portion 91 to be opened/closed by the suction force or discharging force of the coolant gas. A seventh discharging hole 92 is formed at one side of the third suction opening/closing portion 91 in order for the refrigerant gas to be discharged therethrough. A fifth passing-through hole 93 is formed at a predetermined portion so as to spatially communicate with the second discharging hole 88 of the suction gasket 85 in order for the coolant oil 31 to pass therethrough.

A valve sheet 94 include a seventh suction hole 95 formed at the center portion of the same in order for the refrigerant gas to be sucked therethrough. An eighth discharging hole 96 is formed at a predetermined portion so as to spatially communicate with the seventh discharging hole 92 of the suction valve sheet 90, and a sixth passing-through hole 97 is formed at predetermined portion so as to spatially communicate with the fifth passing-through hole 93 of the suction valve 90.

A discharging valve sheet 98 includes an eighth suction hole 99 formed at the center portion of the same in order for the refrigerant gas to be sucked therethrough. A seventh passing-through hole 100 is formed at a predetermined portion so as to spatially communicate with the sixth passing-through hole 97 of the valve sheet 94. A first coolant oil guide hole 101 is formed between the eighth suction hole 99 and the seventh passing hole 100 in order form the coolant oil 31 to be guided. A third discharging opening/closing portion 102 is formed at a predetermined portion so as to spatially communicate with the eighth discharging hole 96 of the valve sheet 94 in order for the third discharging opening/closing section 102 to be opened/closed by the suction force or discharging force of the coolant gas.

A discharging gasket 103 includes an eighth sucking/discharging hole 104 formed at the center portion of the same in order for the refrigerant gas to be sucked/discharged therethrough.

Figure 8:
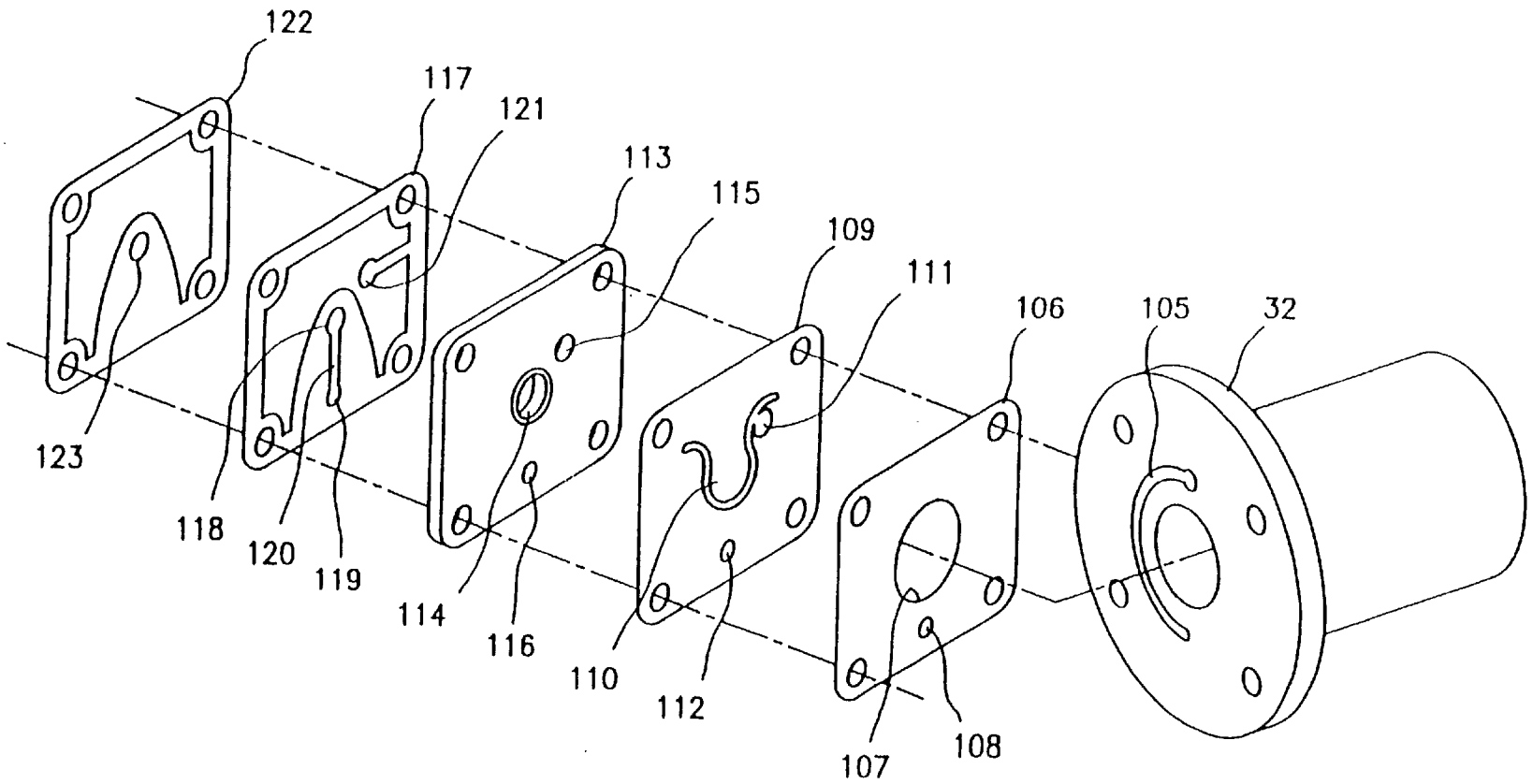
FIG. 8 is an exploded view showing a valve plate of a coolant oil supply apparatus for a linear compressor according to a fourth embodiment of the present invention.

Next, FIG. 8 shows the fourth embodiment of the present invention, which includes a semicircular-shaped fourth guide groove 105 formed at the other side of the cylinder 32 in order for the coolant oil 31 discharged from the coolant oil discharging hole 46 to be guided to the bottom of the system.

A suction gasket 106 includes a ninth sucking/discharging hole 107 formed at the center portion of the same in order for the refrigerant gas to be sucked/discharged therethrough. A fourth guide hole 108 is formed at a predetermined portion so as to spatially communicate with the end portion of the fourth guide groove 105 of the cylinder 32 in order for the coolant oil 31 to be guided.

A suction valve sheet 109 includes a fourth suction opening/closing portion 110 formed at the center portion of the same in order for the fourth suction opening/closing portion 110 to be opened/closed by the suction force or discharging force of the refrigerant gas. A ninth discharging hole 111 is formed at one side of the fourth suction opening/closing portion 10 in order for the refrigerant gas to be discharged therethrough. An eighth passing-through hole 112 is formed at a predetermined portion so as to spatially communicate with the fourth guide hole 108 of the suction gasket 106.

A valve sheet 113 includes a ninth suction hole 114 formed at the center portion of the same in order for the refrigerant gas to be sucked therethrough. A tenth discharging hole 115 is formed at a predetermined portion so as to spatially communicate with the ninth discharging hole 111 of the suction valve sheet 109, and a ninth passing-through hole 116 is formed at a predetermined portion so as to spatially communicate with the eighth passing-through hole 112 of the suction valve sheet 109.

A discharging valve sheet 117 includes a tenth suction hole 118 formed at the center portion of the same in order for the refrigerant gas to be sucked therethrough. A tenth passing-through hole 119 is formed at a predetermined portion so as to spatially communicate with the ninth passing-through hole 116 of the valve sheet 113. A second guide hole 120 is formed between the tenth suction hole 118 and the tenth passing-through hole 119 in order for the coolant oil 31 to be guided thereby. A fourth discharging opening/closing portion 121 is formed at a predetermined portion so as to spatially communicate with the tenth discharging hole 115 of the valve sheet 113.

A discharging gasket 122 includes a tenth sucking/discharging hole 123 formed at the center portion of the same in order for the refrigerant gas to be sucked/discharged therethrough.

The operation and effects of the coolant oil supply apparatus of a linear compressor according to the present invention will now be explained with reference to the accompanying drawings.

First, when a current is applied to the stator 41, magnetic field is generated therearound. At the same time, the magnet 43 is horizontally moved in cooperation with the alternating operation of the stator 41, so that the piston 44 reciprocates horizontally within the cylinder 32.

At this time, the coolant oil 31 filled in the bottom of the housing 30 is sucked to the coolant oil pocket 33 through the capillary tube 36 by the suction force generated by the piston 44. The coolant oil 31 is guided from the coolant oil pocket 33 into the friction portion between the piston 44 and the cylinder 32 through the coolant oil sucking/discharging hole 45 formed at the cylinder 32.

Thereafter, the discharging force generated by the piston 44 serves to push the coolant oil 31 in the cylinder 32 back into the coolant oil pocket 33 through the coolant oil sucking/discharging hole 45. The coolant oil 31 moved to the coolant oil pocket 33 is then returned to the bottom portion of the housing 30. At this time, a predetermined amount of the coolant oil 31 in the coolant oil pocket 33 is forced to the valve plate 47 through the coolant oil discharging hole 46.

Meanwhile, the suction force and discharging force which are generated by the piston 44 serve to cause the refrigerant gas and coolant oil 31 to flow into the valve plate 47 having a predetermined shape. This flow will be explained in more detail.

First, the embodiment of FIG. 5 will be explained.

The refrigerant gas is introduced into the second sucking/discharging hole 66 of the discharging gasket 52 by the suction force generated in the cylinder 32. The introduced refrigerant gas passes through the second suction hole 64 of the discharging valve sheet 51. At this time, the first discharging opening/closing portion 65 of the discharging valve sheet 51 closes the second discharging hole 63 of the valve sheet 50 in response to the suction force of the refrigerant gas.

Thereafter, the refrigerant gas passes through the first suction hole 60 of the valve sheet 50. The refrigerant gas causes the first suction opening/closing portion 57 of the suction valve sheet 49 to be opened and is introduced into the cylinder 32 through the first sucking/discharging hole 53 of the suction gasket 48.

The refrigerant gas is compressed in the cylinder 32 and then is discharged. A predetermined discharging force is generated in cylinder 32. The coolant oil 31 is discharged by the discharging force through the coolant oil discharging hole 46.

The refrigerant gas discharged from the cylinder 32 passes through the first sucking/discharging hole 53 of the suction gasket 48, and pushes the first suction opening/closing portion 57 to close the first suction hole 60 of the valve sheet 50. The refrigerant gas is discharged through the first discharging hole 58 of the suction valve sheet 49, and then passes through the second discharging hole 63 of the valve sheet 50, and pushes the first discharging opening/closing portion 65 of the discharging valve sheet 51. The refrigerant gas is discharged through the second sucking/discharging hole 66 of the discharging gasket 52.

Meanwhile, the coolant oil 31 in the coolant oil pocket 33 is discharged by the discharging force generated in the cylinder 32. The coolant oil 31 discharged from the coolant oil discharging hole 46 of the cylinder 32 is introduced into the first introducing hoke 54 of the suction gasket 48 and then is discharged through the first discharging hole 55 along the first guide hole 56. The coolant oil 31 is then introduced into the second passing-through hole 61 of the valve sheet 50 through the first passing-through hole 59 of the suction valve sheet 49, and then passes through the first suction hole 60 along the discharging valve sheet 51 and is moved to the second sucking/discharging hole 66 of the discharging gasket 52. At this time, a little of the coolant oil 31 passing through the valve plate 47 moves to the friction surface of the corresponding elements so as to seal any gap between the corresponding elements.

Next, FIG. 6 shows another embodiment of the present invention.

The suction force of the cylinder 32 moves the refrigerant gas moves into the cylinder 32 through the sixth sucking/discharging hole 84 of the discharging gasket 83, the sixth suction hole 81 of the discharging valve sheet 80, the fifth suction hole 76 of the valve sheet 75, the second suction opening/closing portion 72 of the suction valve sheet 71, and the fifth sucking/discharging hole 69 of the suction gasket 68.

Thereafter, the refrigerant gas compressed in the cylinder 32 is discharged to the sixth sucking/discharging hole 84 of the discharging gasket 83 through the fifth sucking/ discharging hole 69 of the suction gasket 68, the fifth discharging hole 73 of the suction valve sheet 71, the sixth discharging hole 77 of the valve sheet 75, and the second discharging opening/closing portion 82 of the discharging gasket 80.

Meanwhile, the coolant oil 31 discharged from the coolant oil discharging hole 46 is discharged to the sixth sucking/discharging hole 84 through the second guide groove 67 of the cylinder 32, the second guide hole 70 of the suction gasket 68, the third passing-through hole 74 of the suction valve sheet 71, the fourth passing-through hole 78 of the valve sheet 75, the third guide groove 79 of the valve sheet 75, the fifth suction hole 76 of the valve sheet 75, and the sixth suction hole 81 of the discharging valve sheet 80.

A little of the coolant oil 31 passing through the valve plate moves to the friction portion of the elements and serves to seal any gap therebetween.

Another embodiment of the present invention of FIG. 7 will now be explained.

First, the refrigerant gas is introduced into the cylinder 32 through the eighth sucking/discharging hole 104 of the discharging gasket 103, the eighth suction hole 99 of the discharging valve sheet 98, the seventh suction hole 95 of the valve sheet 94, the third suction opening/closing portion 91 of the suction valve sheet 90, and the seventh sucking/discharging hole 86 of the suction casket 85.

Thereafter, the refrigerant gas in the cylinder 32 is compressed and then is discharged through the seventh sucking/discharging hole 86 of the suction gasket 85, the seventh discharging hole 92 of the suction valve sheet 90, the eighth discharging hole 96 of the valve sheet 94, and the third discharging opening/closing portion 102 of the discharging valve sheet 98.

Meanwhile, the coolant oil 31 discharged through the coolant oil discharging hole 46 is discharged through the second introducing hole 87 of the suction gasket 85, the third guide hole 89, the second discharging hole 88, the fifth passing-through hole 93 of the suction valve sheet 90, the sixth passing-through hole 97 of the valve sheet 94, the seventh passing-through hole 100 of the discharging valve sheet 98, and the first guide hole 101 of the discharging valve sheet 98, the eighth suction hole 99 of the discharging valve sheet 98, and the eighth sucking/discharging hole 104 of the discharging gasket 103. Here, a little of the coolant oil 31 is provided to the friction surface between the elements and serves to seal any gap between the elements.

Next, FIG. 8 shows another embodiment of the present invention.

As shown therein, the refrigerant gas is introduced into the cylinder 32 through the tenth sucking/discharging hole 123 of the discharging gasket 122, the tenth suction hole 118 of the discharging valve sheet 117, the ninth suction hole 114 of the valve sheet 113, the fourth suction opening/closing portion 110 of the suction valve sheet 109, and the ninth sucking/discharging hole 107 of the suction gasket 106.

The refrigerant gas compressed in the cylinder 32 is discharged through the ninth sucking/discharging hole 107 of the suction gasket 106, the ninth discharging hole 111 of the suction valve sheet 109, the tenth discharging hole 115 of the valve sheet 113, the fourth discharging opening/closing portion 121 of the discharging valve sheet 117, and the tenth sucking/discharging hole 123 of the discharging gasket 122.

Meanwhile, the coolant oil 31 discharged through the coolant oil discharging hole 46 is discharged through the fourth guide groove 105 of the cylinder 32, the fourth guide hole 108 of the suction gasket 106, the eighth passing-through hole 112 of the suction valve sheet 109, the ninth passing-through hole 116 of the valve sheet 113, the tenth passing-through hole 119 of the discharging valve sheet 117, the second guide hole 120 of the discharging valve sheet 117, the tenth suction hole 118 of the discharging valve sheet 117, and the tenth sucking/discharging hole 123 of the discharging gasket 122. Here, a little of the coolant oil 31 is provided to the friction portion between the corresponding elements and serves to seal any gap therebetween.

As described above, the present invention is directed to enhancing the cooling efficiency by guiding the coolant oil toward the outer circumferential surface of the cylinder.

In addition, it is possible to enhance the lubricating efficiency of the compressor by supplying the coolant oil to the friction portion between the cylinder and the piston, thus achieving a desired efficiency of the compressor.

Furthermore, it is possible to enhance the efficiency of the compressor by supplying a predetermined amount of the coolant oil to the valve plate and by preventing the leakage of the refrigerant gas.

Although the preferred embodiments of the present invention have been disclosed for illustrative purposes, those skilled in the art will appreciate that various modifications, additions and substitutions are possible, without departing from the scope and spirit of the invention as described in the accompanying claims.

We claim:

1. A coolant supply apparatus for a linear compressor comprising:

a stator mounted at one side of a flange for generating a magnetic field therearound;

a horizontal operating unit which reciprocates horizontally, the horizontal operating unit including a magnet disposed inside the stator and a piston, which is integral with the magnet, horizontally reciprocating within a cylinder;

a coolant oil pocket for guiding a predetermined amount of coolant oil to an outer circumferential surface of the cylinder in cooperation with a suction force of the piston and for cooling a heat generated in the cylinder, wherein said coolant oil pocket includes:

a core liner spaced apart from the outer circumferential surface of the cylinder so as to define a predetermined space therebetween so as to receive a predetermined amount of the coolant oil therein, one end of which being connected to a predetermined portion of the cylinder, and a sealing member disposed between the other end of the core liner and the outer circumferential surface of the cylinder so as to prevent a leakage of the coolant oil filled in the space formed between the core liner and the outer circumferential surface of the cylinder;

a capillary tube connected to the coolant oil pocket so as to supply the coolant oil to a predetermined portion;

a plurality of coolant oil sucking/discharging holes formed at the cylinder in order for the coolant oil filled in the coolant oil pocket to be introduced between the cylinder and the piston therethrough;

a coolant oil discharging hole formed in order for a predetermined amount of the coolant oil filled in the coolant oil pocket to be discharged therethrough; and a valve plate for introducing the coolant oil discharged through the coolant oil discharging hole and for preventing the leakage of a refrigerant gas.

2. The apparatus of claim 1, wherein said valve plate includes:

a suction gasket having an introducing hole formed at an upper portion thereof and spatially communicating with a coolant oil discharging hole, a semicircular-shaped coolant oil guide hole communicating with the introducing portion, and a discharging hole formed at a lower portion thereof in order for the coolant oil to be discharged along the coolant oil guide hole;

a suction valve sheet having a coolant oil passing-through hole spatially communicating with the discharging hole of the suction gasket; and a valve sheet having a coolant oil passing-through hole formed at a predetermined portion so as to spatially communicate with the coolant oil passing-through hole of the suction valve sheet and a coolant oil guide groove formed in order for a part of the coolant oil passing through the coolant oil passing-through hole to be guided to the suction hole.

3. The apparatus of claim 1, wherein said valve plate includes:

a cylinder having a semicircular-shaped coolant oil guide groove communicating with the coolant oil discharging hole in order for the coolant oil to be guided to the bottom portion of a housing;

a suction gasket having a coolant guide hole spatially communicating with the end portion of the coolant oil guide groove of the cylinder in order for the coolant oil to be guided thereby;

a suction valve sheet having a coolant oil passing-through hole formed in order for the coolant oil to be guided and spatially communicating with the end portion of the coolant oil guide groove of the cylinder; and a valve sheet having a coolant oil passing-through hole formed at a predetermined portion so as to spatially communicating with the coolant oil passing-through hole of the suction valve sheet, and a coolant oil guide groove formed in order for a part of the coolant oil passing through the coolant oil passing-through hole to be guided to the suction hole.

4. The apparatus of claim 1, wherein said valve plate includes:

a suction gasket having an introducing hole formed at an upper portion thereof and spatially communicating with the coolant oil discharging hole, a semicircular-shaped coolant oil guide hole communicating with the introducing hole, and a discharging hole formed at a lower portion thereof in order for the coolant oil, which is guided along the coolant oil guide hole, to be discharged;

a suction valve sheet having a coolant oil passing-through hole spatially communicating with the discharging portion of the suction gasket;

a valve sheet having a coolant oil passing-through hole formed a predetermined portion so as to spatially communicate with the coolant oil passing-through hole of the suction valve sheet; and a discharging valve sheet having a coolant oil passing-through hole formed at a predetermined portion so as to spatially communicate with the coolant oil passing-through hole of the valve sheet, a suction hole formed at the upper portion of the coolant oil passing-through hole, and a guide hole communicating with the suction hole and the coolant oil passing-through hole.

5. The apparatus of claim 1, wherein said valve plate includes:

a cylinder having a semicircular-shaped coolant oil guide groove communicating with the coolant oil discharging hole in order for the coolant oil to be guided to the bottom portion of the housing;

a suction gasket having a coolant oil guide hole spatially communicating with the end portion of the coolant oil guide groove of the cylinder in order for the coolant oil to be guided thereby;

a suction valve sheet having a coolant oil passing-through hole spatially communicating with the coolant oil guide hole of the suction gasket in order for the coolant oil to pass therethrough;

a valve sheet having a coolant oil passing-through hole formed at a predetermined portion so as to spatially communicate with the coolant oil passing-through hole of the suction valve sheet; and a discharging valve sheet having a coolant oil passing-through hole formed at a predetermined portion so as to spatially communicate with the coolant oil passing-through hole of the valve sheet, a suction hole formed at the upper portion of the coolant oil passing-through hole, and a guide hole communicating with the suction hole and the coolant oil passing-through hole.

* * * * *